United States Patent [19]

Haensch

[11] Patent Number: 4,886,264

[45] Date of Patent: Dec. 12, 1989

[54] METHOD AND APPARATUS FOR RECEIVING PRINTED PRODUCTS FROM A REVOLVINGLY DRIVEN BUCKET WHEEL OF A PRINTING MACHINE

[75] Inventor: Egon Haensch, Wetzikon, Switzerland

[73] Assignee: Feraf AG, Hinwil, Switzerland

[21] Appl. No.: 259,922

[22] Filed: Oct. 19, 1988

[30] Foreign Application Priority Data

Oct. 23, 1987 [CH] Switzerland ..... 4159/87

[51] Int. Cl.[4] ..... B65H 29/40

[52] U.S. Cl. ..... 271/229; 271/187; 271/204; 271/233; 271/312; 271/315

[58] Field of Search ..... 271/187, 315, 229, 233, 271/307, 308, 312, 82, 277, 204

[56] References Cited

U.S. PATENT DOCUMENTS

| | | | |
|---|---|---|---|
| 4,729,554 | 3/1988 | Honegger | 271/204 X |
| 4,736,936 | 4/1988 | Hertel | 271/187 X |
| 4,743,005 | 5/1988 | Reist | 271/204 X |

FOREIGN PATENT DOCUMENTS

| | | |
|---|---|---|
| 0059873 | 9/1982 | European Pat. Off. . |
| 0067399 | 12/1982 | European Pat. Off. . |
| 0179992 | 5/1986 | European Pat. Off. . |
| 0265735 | 5/1988 | European Pat. Off. . |

*Primary Examiner*—Richard A. Schacher

*Attorney, Agent, or Firm*—Fleit, Jacobson, Cohn, Price, Holman & Stern

[57] ABSTRACT

An outfeed conveyor is arranged beneath a rotary bucket wheel driven to rotate in a predetermined rotational direction. A belt conveyor is arranged downstream of, and a product entrainment arrangement is arranged upstream of, the outfeed conveyor. An endless revolving belt is guided about belt rolls of the outfeed conveyor and upon which come to bear the printed products in inbricated formation. Entrainment elements of the product entrainment arrangement completely stuff the printed products into the pockets of the bucket wheel. Upon ejection of the printed products out of the bucket wheel they are fixedly clamped at their trailing edges between a support element and extensions or cantilever arms of the entrainment elements until the entrainment elements have passed the support element and thus an intersection location between the entrainment elements and the support element. The resiliently arranged extensions of the entrainment elements are pivoted by the support element in a predetermined direction, such as clockwise, so that the printed products are cyclically released. There is thus formed an inbricated formation of the printed products within which all prnited products are aligned and there can be maintained a substantially constant mutual spacing between the individual printed products.

17 Claims, 3 Drawing Sheets

Fig. 3
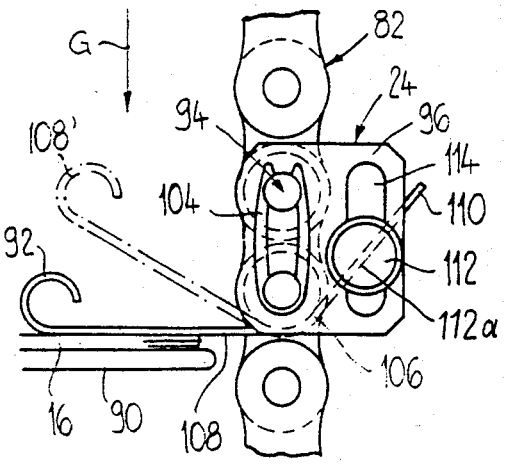
Fig. 4
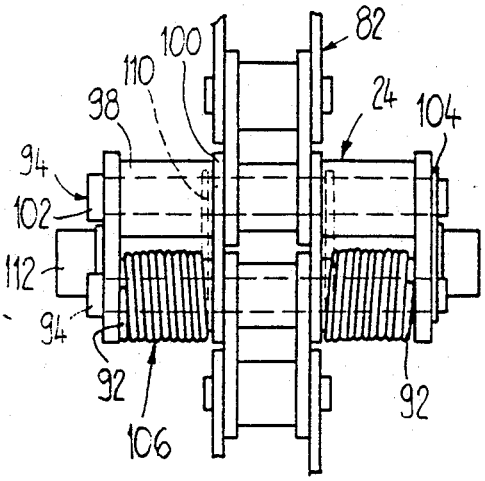
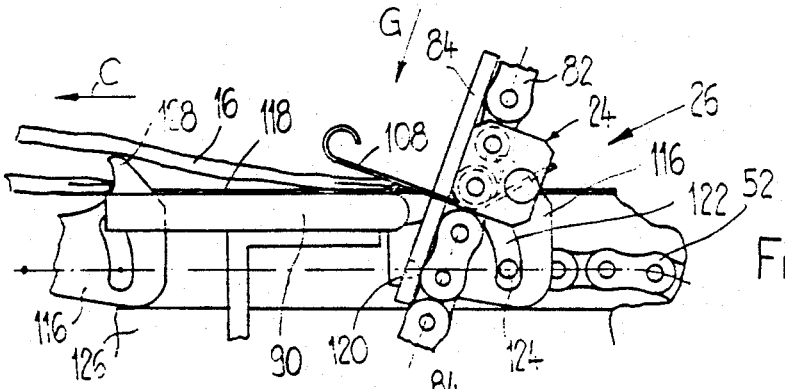
Fig. 5
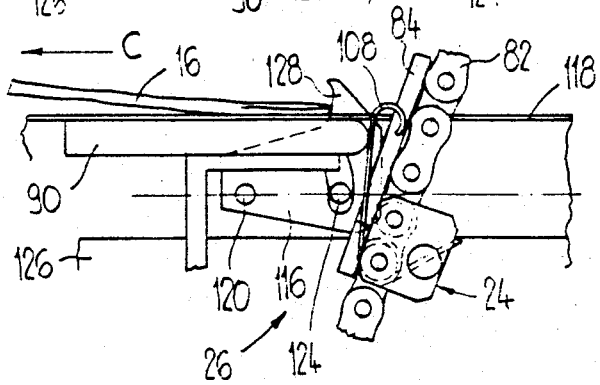
Fig. 6

METHOD AND APPARATUS FOR RECEIVING PRINTED PRODUCTS FROM A REVOLVINGLY DRIVEN BUCKET WHEEL OF A PRINTING MACHINE

CROSS-REFERENCE TO RELATED APPLICATION

This application is related to the commonly assigned, co-pending U.S. application Ser. No. 07/109,365, filed Oct. 19, 1987, and entitled "METHOD AND APPARATUS FOR RECEIVING FOLDED PRINTED PRODUCTS FROM PRINTING MACHINES OR THE LIKE".

BACKGROUND OF THE INVENTION

The present invention relates to a new and improved method of, and apparatus for, receiving or taking-over products, especially printed products from a revolvingly driven bucket or fan wheel.

Generally speaking, the method and apparatus of the present development for receiving or taking-over printed products from a revolvingly driven bucket or fan wheel, especially of a printing machine, such as a printing press, contemplates the employment of entrainment elements which are moved such that the path of travel or motion of the entrainment elements intersects a transport plane defined by an outfeed conveyor. Before or upstream of the intersection location between the path of travel of the entrainment elements and the transport plane of the outfeed conveyor these entrainment elements are brought into engagement with trailing edges of the printed products as viewed with respect to a predetermined direction of rotation of the bucket or fan wheel.

A prior art apparatus of the aforementioned general type is known, for instance, from the European Published patent application No. 0,067,399, published Dec. 22, 1982 and the cognate U.S. Pat. No. 4,487,408, granted Dec. 11, 1984. With this heretofore known apparatus entrainment elements arranged in pairs at two parallel and synchronously revolving supports travel onto trailing edges of the printed products as soon as the leading edges of such printed products have been released from the pockets of the bucket wheel. These entrainment elements thus align the trailing edges of the printed products at right angles to the direction of conveyance of the outfeed conveyor. However, upon stuffing the printed products into the pockets of the bucket wheel it can happen that such printed products tend to cant. The printed products drop in free fall out of the pockets and are frictionally entrained by the printed products which have already been deposited upon the outfeed conveyor and the belts or bands of such outfeed conveyor. Thus, particularly in the case of canted printed products, it is possible that a leading product corner will be engaged by lift-out belts or bands before the entrainment elements have acted in a product aligning fashion upon the trailing edges of the canted printed products. Additionally, printed products along their free path of fall between the bucket wheel and the outfeed conveyor and the supports of the entrainment elements can be uncontrollably acted upon by the air currents of the bucket wheel or by fluttering of the trailing product edges. This can have the undesirable result that the mutual spacing or pitch between the individual printed products in the outfed imbricated or shingled formation of printed products becomes irregular and that individual printed products are arranged in a canted disposition within the imbricated formation of printed products.

Also changes in the rotational velocity of the bucket wheel, in particular, can result in phase shifts, the consequence of which is that there arise irregular or non-uniform mutual spacing or pitch between the printed products.

SUMMARY OF THE INVENTION

Therefore with the foregoing in mind it is a primary object of the present invention to provide a new and improved method of, and apparatus for, receiving or taking-over printed products from a revolvingly driven bucket or fan wheel in manner which does not suffer from the aforementioned drawbacks and shortcomings of the prior art.

Another and more specific object of the present invention is directed to a new and improved method of, and apparatus for, receiving or taking-over printed products from a revolvingly driven bucket or fan wheel of a printing machine, wherein printed products which may have canted or which have not been completely stuffed into the bucket or fan wheel can be positively aligned during the formation of an imbricated or shingled formation of such printed products, and wherein the air currents or air flow produced by the bucket or fan wheel cannot exert any uncontrolled action or effect upon the printed products.

Yet a further noteworthy object of the present invention is directed to a new and improved method of, and apparatus for, receiving or taking-over products, particularly printed products from a revolvingly driven bucket or fan wheel, in a highly reliable and controlled manner affording accurate imbrication or shingling of the printed products.

Still a further notable object of the present invention is concerned with an improved construction of apparatus for the reception or taking-over of printed products from a revolvingly driven bucket or fan wheel of a printing machine, which product reception or take-over apparatus is relatively simple in construction and design, exceedingly reliable in operation, not readily subject to breakdown or malfunction, and requires a minimum of maintenance and servicing.

Now in order to implement these and still further objects of the invention, which will become more readily apparent as the description proceeds, the method of the present development, among other things, is manifested by the features that the printed products are fixedly retained or held at the intersection or cross-over location between the path of travel of the entrainment elements and the transport plane defined by the outfeed conveyor, by such entrainment elements until these entrainment elements have passed or moved through the intersection or cross-over location.

As alluded to above, the invention is not only concerned with the aforementioned method aspects, but also pertains to a new and improved construction of product receiving or take-over apparatus which, among other things, is designed such that the entrainment elements fixedly retain or hold the printed products at the aforementioned intersection or cross-over location until the entrainment elements have passed through such intersection or cross-over location.

Since the printed products are briefly held or retained at the aforementioned intersection or cross-over location between the path of travel of the entrainment elements and the transport plane of the product outfeed conveyor, until the entrainment elements have passed through such intersection or cross-over location, the printed products can only be outfed or transported away by the outfeed conveyor in the cycle or cadence of release of the printed products by the entrainment elements. In this way there is realized an exact mutual spacing or pitch of the printed products as well as there being imposed upon the printed products an exact alignment of the trailing product edges in a direction transverse to the direction of conveyance or feed of the printed products by the outfeed conveyor.

According to a preferred exemplary embodiment of the invention, the printed products are fixedly clamped at the intersection location between the entrainment elements and a support element and each of the entrainment elements which are momentarily effective for fixedly retaining or clamping a related printed product are brought out of engagement with such printed product by means of the support element. This affords in a most simple fashion an exceedingly protective clamping and subsequent release of the printed products.

According to a further preferred embodiment of the invention the entrainment elements, upstream or before reaching the intersection or cross-over location, engage into the pockets or compartments of the bucket or fan wheel in order to displace or shove protruding printed products into these pockets or compartments of the bucket or fan wheel. In this way, there is beneficially ensured that the printed products are completely stuffed or inserted into the pockets or compartments of the bucket or fan wheel and the trailing product edges already come to bear upon the support element in an aligned disposition. In this way there is prevented, in particular, fluttering of the trailing product edges.

The entrainment elements each preferably possess a pivotable and resilient or springy extension or prolongation, such as in the form of a cantilever arm or finger, and such extension or prolongation is preferably formed by a first end of a helical spring arrange transverse to a conveyor element. The second end of such helical spring or spring member is adjusted with respect to the conveyor element. Such construction of entrainment element is exceedingly simple in design, since the extension or prolongation and the spring element of each entrainment element form a unitary structure or unit.

According to a further advantageous embodiment of the invention, the fixation of the second end of the helical spring is adjustable. In this way there can be adjusted or set the period of time of retention or grasping of the printed product at the aforementioned intersection or cross-over location by the entrainment elements.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 3 illustrates in fragmentary side view a conveyor element in the form of a conveyor chain equipped with entrainment elements;

FIG. 4 is a fragmentary front view of the conveyor chain equipped with the entrainment elements as depicted in FIG. 3;

FIG. 5 illustrates on an enlarged scale, in relation to the showing of FIG. 1, details of the intersection or cross-over location between the path of travel of the entrainment elements and the transport plane of the product outfeed conveyor; and FIG. 6 is an illustration comparable to the showing of FIG. 5 but depicting the arrangement at a later phase in the operation thereof.

DETAILED DESCRIPTION OF THE PREFERRED EMBODIMENTS

Describing now the drawings, it is to be understood that to simplify the showing thereof, only enough of the construction of the apparatus for the reception or taking-over of products, especially printed products and in particular folded printed products, from a revolvingly driven or rotary bucket or fan wheel of a printing machine and the therewith related structure thereof have been illustrated therein as is needed to enable one skilled in the art to readily understand the underlying principles and concepts of this invention.

Figure 1:
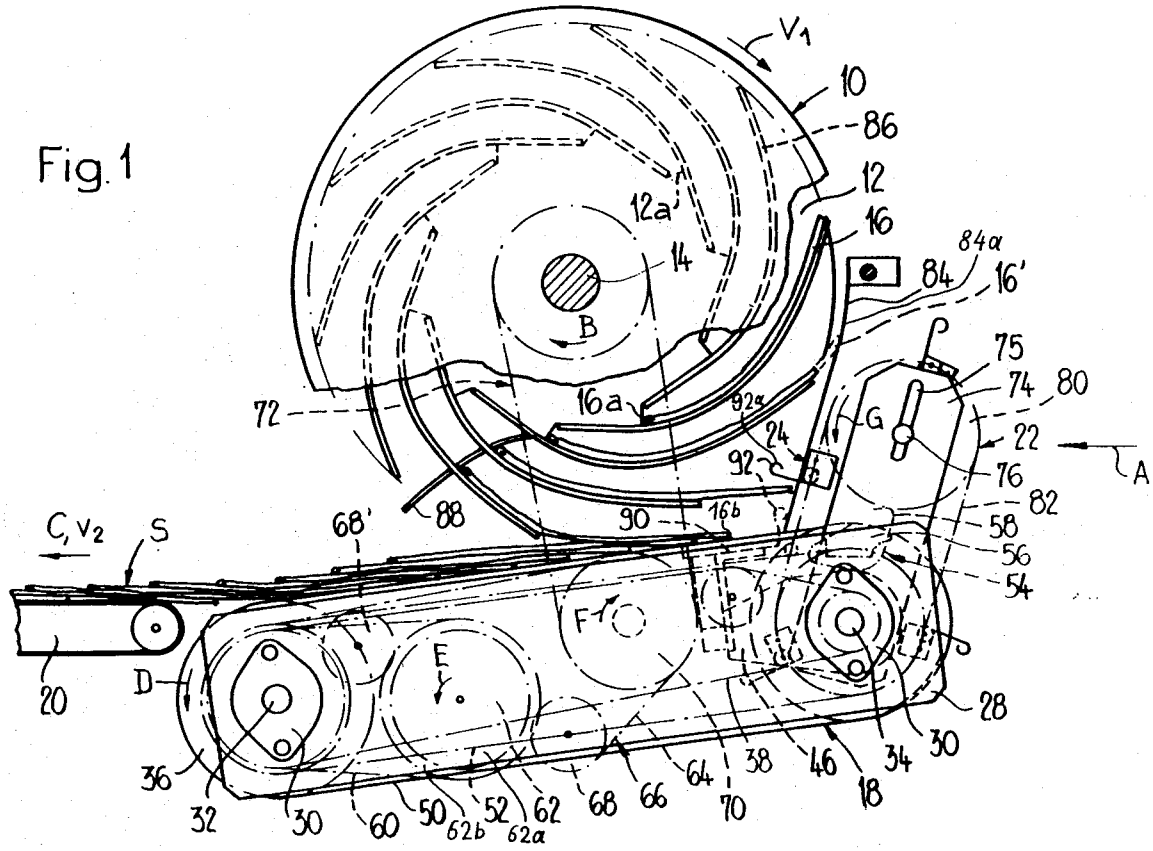
FIG. 1 schematically illustrates in side view, partially in section, an apparatus for receiving or taking-over printed products from a revolvingly driven bucket or fan wheel and constructed according to the present invention.

Turning attention now specifically to FIG. 1, there has been schematically depicted therein a rotary bucket or fan wheel or wheel structure 10 of a printing machine. This rotary bucket or fan wheel 10 comprises a multiplicity of pockets or compartments or buckets 12 which are open at the circumference of the rotary bucket or fan wheel 10. The base or floor of these pockets or compartments 12 has been conveniently designated by reference character 12*a*. The bucket or fan wheel 10 is rotatably mounted at a stationary shaft 14 and is revolvingly driven by any suitable drive in the direction of the arrow B at the circumferential velocity $v_1$. A suitable and therefore not particularly illustrated product folding apparatus is arranged upstream of the bucket or fan wheel 10 and from which there are delivered folded printed products 16, for instance newspapers, magazines, periodicals or the like, which drop into the pockets or compartments 12 of the bucket or fan wheel 10. As will be particularly evident by further inspecting FIG. 1, the printed products 16 drop out of the conventional product folding apparatus with each of their product fold edges 16*a* leading. This product fold edge 16*a*, as viewed in the direction of rotation B of the bucket or fan wheel 10, constitutes the leading product edge.

Continuing, it will be observed that a product outfeed conveyor or conveyor device 18 is arranged beneath the bucket wheel 10. A belt or band conveyor 20 for the outfeed or transporting away of the imbricated or shingled formation S of the printed products 16 which have been formed upon the product outfeed conveyor 18 is arranged downstream of such product outfeed conveyor 18 as viewed with respect to the direction of travel or conveyance of the printed products 16. On the other hand, an entrainment arrangement or entrainment structure 22 is arranged upstream of the product outfeed conveyor 18. The entrainment arrangement 22 is provided with entrainment elements 24. The path of movement of these entrainment elements 24 along the conveying-active path or run of the belt-like entrainment arrangement 22 intersects a transport plane defined by the product outfeed conveyor 18 at an intersection or cross-over location 26. The direction of conveyance of the outfeed conveyor 18 as well as the belt or band conveyor 20 have been indicated by reference character C, and the direction of product conveyance or feed of the entrainment arrangement 22 has been designated by reference character G (see FIG. 3). The conveying velocity of the product outfeed conveyor 18 and the belt or band conveyor 20 each amounts to $v_2$.

Figure 2:
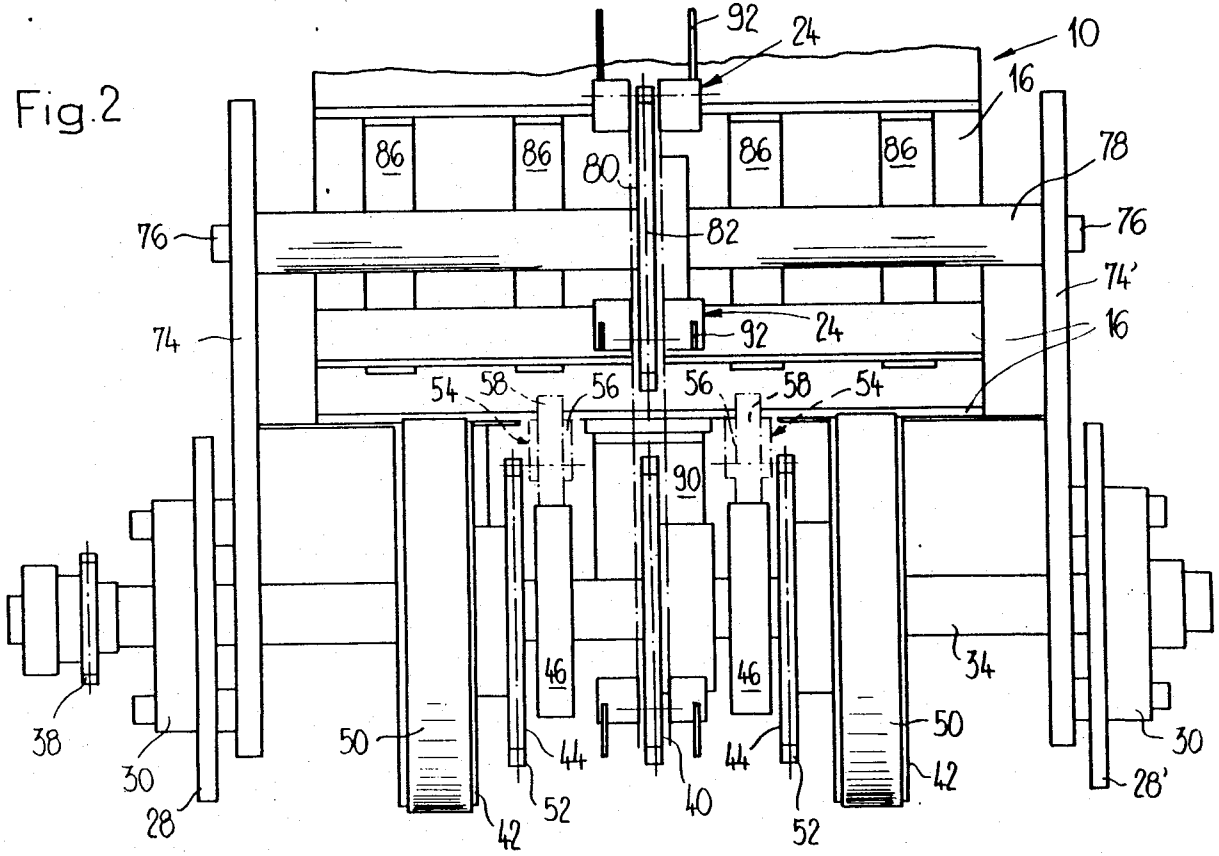
FIG. 2 illustrates on an enlarged scale the lower half of the product reception or take-over apparatus depicted in FIG. 1, as generally viewed when looking in the direction of the arrow A of such FIG. 1.

By referring to FIGS. 1 and 2, it will be observed that bearing or support elements 30 are arranged in pairs at the end regions of substantially parallel side or cheek plates 28 and 28'. Two substantially parallel shafts or shaft members 32 and 34 are rotatably mounted at the bearing elements 30. A pair of mutually spaced belt or band rolls 36 are rigidly connected for rotation with the shaft 32 which is driven to rotate in the direction of the arrow D. This shaft or shaft member 32 is operatively connected with the shaft 34 for adjustment in its phase position by means of the chain-dot depicted chain drive 38. A sprocket wheel 40 is rigidly connected for rotation with the shaft or shaft member 34. Also a further pair of belt or band rolls 42 and deflection chain wheels 44 are rotatably mounted at the shaft 34. At the region of such shaft 34 there are arranged two cams or cam members 46 which terminate in a wedge-shaped configuration in the direction of the shaft 32 and which coaxially engage about the shaft 34. Furthermore, at the shaft or shaft member 32 there are arranged two corresponding cams or cam rolls. At the shaft 32 there are likewise analogously provided deflection chain wheels 44 and belt or band rolls or rollers 36. Two substantially parallel, endless belts or bands 50 train about the belt or band rolls or rollers 36 and 42.

Furthermore, it will be observed that two substantially parallel endless chains or chain members 52 are guided about the deflection chain wheels or wheel members 44 arranged at the shafts 32 and 34. These deflection chain wheels 44 are driven in such a manner that the circumferential velocity of the chains or chain members 52 is equal to the circumferential velocity of the belts or bands 50. Grippers or gripper elements 54 which have been depicted in chain-dot lines are arranged at a fixed mutual spacing or pitch from one another at the chains 52. These grippers 54 possess gripper bodies or body members 56 which are laterally secured at the chains or chain members 52 and at which there are arranged resilient or spring fingers 58. At the region of the shafts 32 and 34 the resilient or spring fingers or finger members 58 are placed by means of the cams 46 and the associated cam rolls into the broken line depicted open position. Upon travel of the fingers or finger members 58 from the cams 46 or the cam rolls, these fingers or finger members 58 assume a product clamping position and thus clamp at the conveying-active path the trailing edges of the printed products 16 or bear upon the non-conveying active path at the gripper bodies 56. In FIGS. 1 and 2 there has only been illustrated one pair of grippers or gripper elements 54.

The shaft 32 is operatively connected by means of a further chain drive 60 with the power take-off side of a differential gearing or transmission 62 which is likewise rotatably mounted at the side plates 28 and 28'. A chain-dot depicted chain or chain member 64 of a further chain drive 66 trains about the drive gear or wheel 62*a* of the differential gearing 62 by means of the deflection wheels 68 and 68', resulting in a reversal in the direction of rotation in relation to the driven sprocket wheel 70 (cf. the arrows E and F). The sprocket wheel 70 is driven by means of a chain-dot depicted chain drive 72 from the shaft 14 of the bucket or fan wheel 10. By means of the differential gearing or transmission 62 it is possible to adjust a phase shift between the bucket or fan wheel 10 and the product outfeed conveyor 18 as well as the entrainment arrangement 22 in that, for instance, there can be briefly increased or reduced the relative rotational speed between the drive gear 62*a* and power take-off gear 62*b* of the differential gearing 62.

As will be evident from FIGS. 1 and 2, holder or holding plates 74 and 74' are secured at the side plates 28 and 28', respectively, at the region of the shaft or shaft member 34. A shaft or shaft member 78 is fixed at the holder plates 74 and 74' within elongate holes or slots 75 by means of the threaded bolts 76 or equivalent structure. A sprocket wheel 80 is rotatably mounted at the shaft 78. An endless revolving conveyor chain or chain member 82 is guided about both of the sprocket wheels 40 and 80. The previously mentioned entrainment elements 24 are arranged at a fixed mutual spacing from one another at the conveyor or conveying chain 82. These entrainment elements 24 will be described more fully hereinafter. A guide member 84, for instance formed of sheet metal or metal plating, is arranged parallel to the conveying-active run of the conveyor chain 82 between the latter and the bucket or fan wheel 10. This guide member 84 protrudes past the upper end of the entrainment arrangement 22 and at that location is bent substantially parallel to the outer surface of the bucket or fan wheel 10. The lower end of the guide member 84 extends to the intersection or cross-over location 26.

In FIG. 2 there has not been illustrated the aforementioned sheet metal guide member 84 in order not to cover the portrayal as seen in the direction of the arrow A looking into the interior of the bucket or fan wheel 10, of which there is only visible the lower half region. In FIG. 1 it should be understood that reference character 16' designates the trailing edge of a printed product 16 which wipingly contacts the guide member 84 at its upper end region 84*a* because the corresponding printed product 16 does not bear against the base or floor 12*a* of the related pocket or compartment 12.

The pockets 12 of the bucket or fan wheel 10 are formed by a plurality of substantially mutually parallel arranged and flexed pocket or compartment members 86, again formed of sheet metal or metal plating, and as particularly well seen by referring to FIG. 2. Between the sheet metal pocket or compartment members 86 which are spaced from one another in the axial direction of the shaft or shaft member 14, there are arranged in each case ejector or stripper elements 88, one of which has been conveniently depicted in FIG. 1. Upon ejection or stripping of the printed products 16 out of the bucket or fan wheel 10, the products edges 16*a*, which will become the leading product edges in the imbricated product formations, come to bear at the ejector or stripper elements 88.

A support element or support means 90, for instance formed of a suitable synthetic or plastic material, is arranged at the aforementioned intersection or cross-over location 26 substantially parallel to the conveying-active run of the belts or bands 50. As will be discussed more fully hereinafter, the trailing edges 16*b* of the printed products 16 come to bear upon such support element 90. Also this support element 90 serves to pivot or rock the pivotally and resiliently mounted extensions or prolongations 92 of the entrainment elements 24 out of the region where such extensions or prolongations 92 act upon the printed products 16. These extensions or prolongations 92 of the entrainment elements 24 protrude, along their conveying-active path, beyond the sheet metal guide member 84 and engage at their free ends 92*a* into the pockets or compartments 12 of the bucket or fan wheel 10.

In FIGS. 3 and 4 there have been illustrated on an enlarged scale a number of the parts or components of the conveyor chain 82 together with a pair of entrainment elements 24 which are affixed thereto. At the free ends of two longer bolts or bolt members 94 of the conveyor chain 82 there are inserted two entrainment plates or plate members 96. Spacer sleeves or sleeve members 98 space these entrainment plates 96 from the brackets or links 100 of the conveyor chain 82. At one end the bolts or bolt members 94 are provided with a head or head portion 102 and the other end is fixedly retained against axial shifting or displacement by means of a clamp or clip 104 or equivalent structure. Viewed in the conveying direction G of FIGS. 4 and it will be seen in FIG. 4 that there is wound about each of the spacer sleeves or sleeve members 98 arranged at the leading bolt or bolt member 94 a respective helical spring or spring member 106 and which are wound in opposite sense. The first free spring end portion 108 is bent into a substantially hook-shaped configuration at its end region or free end 92*a* and assumes the previously described function of the extension or prolongation 92 of the related entrainment element 24 (cf. also FIG. 1). The second spring end or end portion 110 piercingly extends through a radial hole or opening 112*a* in a fixation bolt or bolt member 112. This fixation or fixing bolt 112 is displaceably mounted in an elongate hole or slot 114 in each entrainment plate 96 and which extends parallel to the related chain bracket or link 100. In the position depicted with full lines in FIG. 3 the first spring end portion 108 is disposed approximately at right angles to the conveyor chain 82 with reference to the direction of the arrow G. By displacing the fixation or fixing bolt 112 in the elongate hole or slot 114 in the direction of the arrow G, the first spring end portion 108 can assume the rest position shown in chain-dot lines and designated by reference character 108'. However, this first spring end portion 108 also can be brought into a rest position which leads with respect to the entrainment plates 96 by shifting the fixation or fixing bolt 112 opposite to the direction of the arrow G. The trailing edge 16*b* of each printed product 16 is deposited upon the support element 90 and is clamped or seized between such support element 90 and the first spring end portion 108.

Turning attention now to FIGS. 5 and 6, there has been shown on an enlarged scale the intersection or cross-over location 26. It will also be seen that at each chain or chain member 52 there are arranged at a fixed mutual spacing from one another the cams or dogs 116 which come to bear at the trailing edges 16*b* of the printed products 16 and displace such along a conveyor plate 118, for instance formed of sheet metal or metal plating in the conveying direction C. The cams or dogs 116 are pivotably mounted at bolts 120 of the chain or chain member 52. An elongate hole or slot 122 at the cams or dogs 116 and arranged concentrically with respect to the associated bolt or bolt member 120 is pivotably guided in a neighboring further bolt or bolt member 124 of the chain or chain member 52. Upon travel of each cam or dog 116 upon a cam or control element 126, each such cam or dog 116 is pivoted or rocked in the counter-clockwise direction, so that a hook or hook member 128 or equivalent structure formed at the associated cam or dog 116 protrudes beyond the sheet metal conveyor plate 118. In FIG. 6 there has only been shown in chain-dot lines the chain or chain member 52. At the intersection or cross-over location 26, there intersect the path of movement of the entrainment elements 24 and the transport plane of the product outfeed conveyor 18 which is defined by the sheet metal conveyor plate 118 depicted in FIGS. 5 and 6. The conveyor chain 82 extends substantially parallel to the sheet metal guide member 84. The first spring end portion 108 of the entrainment element 24 protrudes beyond the sheet metal guide member 84.

Based upon the illustration of FIGS. 3, 5 and 6 there will now be described the operation of an entrainment element 24 as well as the cams or dogs 116 in greater detail.

The first spring end portions 108 of each entrainment element 24 which is moved in the conveying direction G come into contact with the printed product 16 which bears upon the support element 90. The trailing edge 16*b* of the printed product 16 is fixedly clamped or engaged between the support element 90 and the first spring end portions 108, as will be recognized by referring to FIGS. 3 and 5. During further travel of the entrainment element 24 in the direction of the arrow G each first spring end portion 108 is rocked or rotated in the clockwise direction owing to the action of the support element 90 until these first spring end portions 108 release the trailing edge 16*b* of the related printed product 16, as also recognized by referring to FIG. 6. Shortly before the printed product 16 has been released a hook or hook member 128 of each cam or dog 116 arranged at the chains 52 come to bear at the trailing product edge 16*b* and convey the printed product 16 in the direction of the arrow C. As soon as the free end of each spring end portion 108 has passed by the support element 90, then it rocks back into its original position in counter-clockwise direction. The conveying velocity of the chains 52 and the conveyor chain 82 as well as the spacing or pitch of the entrainment elements 24 and the cams or dogs 116 are coordinated or matched to one another such that at each printed product 16 released by the bucket or fan wheel 10 there comes to bear an entrainment element 24, and shortly before such time that the printed product 16 is released by the entrainment element 24, this printed product 16 is engaged at its trailing edge by the hooks or hook members 128 of the cams or dogs 116.

Based upon the illustration of FIG. 1 there will now be described the operation of the apparatus for the reception or taking-over of printed products 16 from a revolvingly driven bucket or fan wheel 10 of a printing machine. The printed products 16 are stuffed in known manner from above into the pockets or compartments or buckets 12 of the rotary bucket or fan wheel 10. In the event that during this stuffing operation a printed product 16 is canted or has not been adequately stuffed into the related pocket or compartment 12 such that the printed product contacts the base or floor 12*a* of the related pocket or compartment 12, as such has been indicated for the printed product 16' in FIG. 1, then the first free spring end portions 108 of the entrainment elements 24 and which revolve about the sprocket wheel 80 come to bear upon the trailing edge 16*b* of the corresponding printed product 16'. As a result, this printed product 16' is displaced within the related pocket or compartment 12 until the leading edge 16*a* bears upon the base or floor 12*a* of such pocket or compartment 12. The conveying velocity of the entrainment arrangement 22 is chosen in such a manner that it is equal to or greater than the velocity of the trailing edges 16*b* of the printed products 16 upstream of the intersection or cross-over location 26. The velocity of the first free spring end portions or ends 108 is however increased owing to the curvature at the region of the sprocket wheel 80 so that there is engaged the trailing product edge 16' sliding upon the sheet metal guide member 84 and, thus, the corresponding printed product 16 is conveyed completely into the pocket or compartment 12. This ensures that all of the leading product edges 16*a* will bear against the floor or base 12*a* of the pockets or compartments 12 of the bucket or fan wheel 10 and will be thus aligned. During further rotation of the bucket or fan wheel 10 in the direction of the arrow B the leading product edges 16*a* come to bear against the ejector or stripper element 88. As a result, the printed products 16 slide out of the pockets or compartments 12 of the rotary bucket or fan wheel 10.

Moreover, by virtue of the described operation, the trailing edge 16*b* of each printed product 16 comes to bear upon the support element 90 and at that location, as has already been discussed previously, is fixedly clamped by the entrainment element 24 which is then associated with the trailing edge 16*b* of the printed product 16 for such length of time until the entrainment element 24 has passed beyond the intersection or cross-over location 26 and the support element 90 has pivoted or rocked back the first free spring end portions 108 out of the effectual region where such act upon the printed products 16. The friction between the printed product 16 which has been last placed upon the imbricated formation S of such printed products and the printed product 16 which has been released by the entrainment element 24 is of such a magnitude that there cannot arise any relative displacement or shifting between both of these printed products 16.

The mutual spacing or pitch of the printed products 16 in the imbricated formation S of such printed products 16 is governed by the frequency of the laid out printed products 16 as well as the conveying velocity $v_2$ of the outfeed conveyor 18 and the belt or band conveyor 20.

With the apparatus as proposed, the printed products 16 do not move through any path in a free fall, thereby rendering impossible product displacement due to air currents or air flows generated by the bucket or fan wheel 10. As already previously explained, all of the printed products 16 are aligned and their mutual spacing or pitch is essentially constant within the imbricated product formation S because the printed products 16 are beneficially briefly retained or held at the intersection or cross-over location 26. By means of the grippers or gripper elements 54 depicted in chain-dot lines in FIG. 1, the printed products 16 can be fixedly retained at the conveying-active path or run of the product outfeed conveyor 18 so that there is no longer possible any product shifting or displacement and this is also true in the case of the product outfeed conveyor 18 provided with the cams or dogs 116. It is possible to also dispense with the use of the grippers or gripper elements 54. In that case, there is no need, of course, for the chains or chain members 52 together with the deflection wheels 44, resulting in an appreciable structural simplification of the apparatus.

It should be readily apparent that due to the preselectable rest position of the first spring end portion 108 and 108' (see also FIG. 3) of the entrainment elements 24, there can be adjusted the time duration during which there are fixedly retained the printed products 16 at the intersection or cross-location 26. Such time duration is longer for the rest position depicted by reference numeral 108 than for the rest position depicted by reference character 108'.

While there are shown and described present preferred embodiments of the invention, it is to be distinctly understood that the invention is not limited thereto, but may be otherwise variously embodied and practiced within the scope of the following claims.

Accordingly, what I claim:

1. A method for receiving printed products from a revolvingly drivable bucket wheel of a printing machine, comprising the steps of:

providing a product outfeed conveyor having a transport plane for the printed products defined by the product outfeed conveyor;

moving entrainment elements for the printed products through a path of travel which intersects the transport plane defined by the product outfeed conveyor at a predetermined intersection location;

engaging trailing edges of the printed products, as viewed with respect to a predetermined direction of rotation of the revolvingly drivable bucket wheel, by means of the entrainment elements; and fixedly retaining the printed products at the intersection location by means of said entrainment elements until said entrainment elements have passed beyond said intersection location.

2. The method as defined in claim 1, further including the steps of:

fixedly clamping the printed products at the intersection location between the entrainment elements and a support element; and utilizing said support element for bringing said entrainment elements out of engagement with said printed products.

3. A method for receiving printed products from a rotatable bucket wheel, comprising the steps of:

providing a product outfeed conveyor having a transport plane for the printed products defined by the product outfeed conveyor;

moving entrainment means for the printed products through a path of travel which intersects the transport plane defined by the product outfeed conveyor at a predetermined intersection location;

engaging trailing edges of the printed products, as viewed with respect to a predetermined direction of rotation of the rotary bucket wheel, by means of the entrainment means; and holding the printed products at the intersection location by means of said entrainment means until said entrainment means have moved through said intersection location.

4. An apparatus for receiving printed products from a revolvingly drivable bucket wheel of a printing machine, comprising:

a product outfeed conveyor defining a transport plane for the printed products;

a plurality of entrainment elements;

means for moving said plurality of entrainment elements through a predetermined path of travel which intersects the transport plane defined by the product outfeed conveyor at a predetermined intersection location;

said means for moving said entrainment elements placing said entrainment elements into engagement with trailing edges, as viewed with respect to a predetermined direction of rotation of the revolvingly drivable bucket wheel, of the printed products at a location upstream of the predetermined intersection location; and said entrainment elements retaining the printed products at the predetermined intersection location until said entrainment elements have passed through said predetermined intersection location.

5. The apparatus as defined in claim 4, further including:

support means arranged at said predetermined intersection location; and the trailing edges of said printed products being supportable upon said support means under the action of said entrainment elements.

6. The apparatus as defined in claim 5, wherein:

said support means coacts with said entrainment elements such as to pivot said entrainment elements out of said engagement with said printed products.

7. The apparatus as defined in claim 4, further including:

a revolvingly driven bucket wheel containing pockets for receiving the printed products; and said entrainment elements engaging with the pockets of the bucket wheel at a location upstream of said predetermined intersection location in order to stuff protruding printed products into the pockets.

8. The apparatus as defined in claim 4, wherein:

said means for moving said entrainment elements through said predetermined path of travel comprises a revolvingly drivable endless conveyor element at which there are arranged said entrainment elements.

9. The apparatus as defined in claim 8, wherein:

said conveyor element comprises a conveyor chain; and said entrainment elements being arranged in pairs at opposite side regions of said conveyor chain.

10. The apparatus as defined in claim 9, wherein:

each entrainment element comprises a pivotably mounted resilient extension.

11. The apparatus as defined in claim 10, wherein:

each pivotably mounted resilient extension comprises a helical spring having a first end portion arranged substantially transversely with respect to said conveyor element and a second end portion which is fixed with respect to said conveyor element; and means for fixing said second end portion of said helical spring with respect to said conveyor element.

12. The apparatus as defined in claim 10, wherein:

said fixing means for the second end portion of said helical spring comprises adjustable fixing means.

13. The apparatus as defined in claim 10, further including:

a revolvingly drivable bucket wheel;

guide means arranged between said revolvingly drivable bucket wheel and said conveyor element; and said guide means serving to bring each of said extensions into a position protruding towards said revolvingly drivable bucket wheel.

14. The apparatus as defined in claim 13 wherein:

said guide means comprises a guide plate.

15. The apparatus as defined in claim 4, further including:

cam means provided for said product outfeed conveyor; and said cam means being engageable with trailing edges of printed products deposited upon the product outfeed conveyor.

16. The apparatus as defined in claim 15, further including:

gripper means provided for said product outfeed conveyor; and said gripper means being engageable trailing edges of printed products deposited upon the product outfeed conveyor.

17. An apparatus for receiving printed products from a revolvingly driven bucket wheel of a printing machine, comprising:

a revolvingly driven bucket wheel;

product outfeed conveyor means defining a transport plane for the printed products;

entrainment means;

means for moving said entrainment means through a predetermined path of travel which intersects the transport plane defined by the product outfeed conveyor means at a predetermined intersection location;

said means for moving said entrainment means placing said entrainment means into engagement with trailing edges, as viewed with respect to a predetermined direction of rotation of the revolvingly driven bucket wheel, of the printed products at a location upstream of the predetermined intersection location; and said entrainment means engaging the printed products at the predetermined intersection location until said entrainment means have passed through said intersection location.

* * * * *